United States Patent [19]

Minegishi et al.

[11] 4,144,177

[45] Mar. 13, 1979

[54] SOFTENER COMPOSITION FOR FABRICS

[75] Inventors: Yutaka Minegishi, Saitama; Haruhiko Arai, Narashino, both of Japan

[73] Assignee: Kao Soap Co., Ltd., Tokyo, Japan

[21] Appl. No.: 840,401

[22] Filed: Oct. 7, 1977

[30] Foreign Application Priority Data

Oct. 19, 1976 [JP] Japan ..... 51/125938

[51] Int. Cl.[2] ..... D06M 13/36

[52] U.S. Cl. ..... 252/8.8; 8/115.6; 252/8.75

[58] Field of Search ..... 252/8.75, 8.8; 8/115.6

[56] References Cited

U.S. PATENT DOCUMENTS

| | | | |
|---|---|---|---|
| 3,573,091 | 3/1971 | Waldman et al. | 252/8.8 |
| 3,622,378 | 11/1971 | Proffitt | 252/8.75 |
| 3,686,025 | 8/1972 | Morton | 252/8.75 |
| 3,703,480 | 11/1972 | Grand et al. | 252/8.75 |
| 3,775,051 | 11/1973 | Graff | 252/8.75 |
| 3,862,058 | 1/1975 | Nirschl et al. | 252/8.8 |
| 3,920,563 | 11/1975 | Wixon | 252/8.75 |
| 3,920,565 | 11/1975 | Morton | 252/8.75 |

*Primary Examiner*—William E. Schulz

*Attorney, Agent, or Firm*—Blanchard, Flynn, Thiel, Boutell & Tanis

[57] ABSTRACT

A fabric softening composition comprising an anionic surfactant and a quaternary ammonium salt having two long chain alkyl or β-hydroxy alkyl groups and one or two hydroxyethyl or hydroxypropyl groups.

7 Claims, No Drawings

SOFTENER COMPOSITION FOR FABRICS

BACKGROUND OF THE INVENTION

1. Field of the Invention

The present invention relates to a softener composition for fabrics, which composition has excellent softening and antistatic effects to various fibers and has a good dispersibility.

2. Description of the Prior Art

Most of the current commercially available fabric softeners for ordinary household use are compositions comprising, as a main ingredient, a quaternary ammonium salt having in the molecule 1 or 2 long-chain alkyl groups. Such quaternary ammonium salts exert a very high softening effect to cotton fibers even when used in a small amount. Recently, in households, the proportion of synthetic fibers in cloth materials has rapidly increased. However, clothes containing synthetic fibers become hard when they are repeatedly worn and washed, and they are readily electrostatically charged. Therefore, they should be subjected to softening and antistatic treatments.

Quaternary ammonium salts of the type mentioned above have a very high softening effect to cotton fibers but it cannot be said that they are completely satisfactory in both the softening and antistatic effects to synthetic fibers. Among industrial fabric softeners, which are not used in ordinary households, there are only a few softeners which are satisfactory in both the softening and antistatic effects to synthetic fibers. Accordingly, in general, there are used for treating fabrics containing synthetic fibers fabric softener compositions comprising the combination of agents possessing an excellent softening effect and agents possessing an excellent antistatic effect. Further, agents which possess both satisfactory softening and antistatic effects to synthetic fibers must be employed at a very high concentration and therefore, they are not suitable as active ingredients of fabric softener compositions for ordinary household use. Moreover, these softeners for synthetic fibers are inferior in the softening effect to cotton fibers.

As will be apparent from the foregoing description, there has not been developed a household fabric softener having a high softening effect to various types of fibers, both natural and synthetic, and which imparts an excellent antistatic effect to synthetic fibers.

It is therefore a primary object of the present invention to provide a fabric softener composition having a high softening effect to cotton as good as the softening effect of conventional fabric softeners used in household fabric softening treatments, and also having much higher softening and antistatic effects to synthetic fibers than conventional fabric softeners.

SUMMARY OF THE INVENTION

In accordance with the present invention, there is provided a softener composition for fabrics comprising (A) a quaternary ammonium salt having the formula:

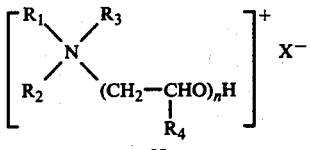

or

-continued

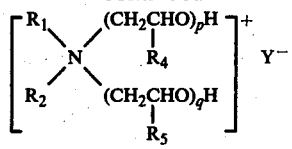

wherein $R_1$ and $R_2$ each are alkyl having 12 to 22 carbon atoms or β-hydroxyalkyl having 13 to 24 carbon atoms, $R_3$ is alkyl having 1 to 3 carbon atoms, $R_4$ and $R_5$ each are hydrogen or methyl, X is halogen, a monoalkyl sulfuric acid group in which the alkyl group has 1 to 3 carbon atoms or a monocarboxylic acid group having 2 or 3 carbon atoms, Y is halogen or a monocarboxylic acid group having 2 or 3 carbon atoms, n is a number of from 1 to 3, and p and q each are a number of 1 or 2 with the proviso that the sum of p and q is 2 or 3, and (B) an anionic surface active agent, the mixing molar ratio of (A):(B) being in the range of from 1:0:3 to 1:1.

Fabric softener compositions comprising the combination of a quaternary ammonium salt and an anionic surface active agent are disclosed in U.S. Pat. No. 3,920,563 (issued to Wixon on Nov. 18, 1975) and U.S. Pat. No. 3,920,565 (issued to Morton on Nov. 18, 1975). In these known softener compositions, a tetra-alkyl ammonium salt, a trialkylbenzyl ammonium salt or an imidazolium salt is used as the quaternary ammonium salt. Further, the purposes of using such compositions is to prevent degradation of the fabric softening effect that would otherwise occur owing to deactivation of the quaternary ammonium salt caused by the residual anionic detergent component left after washing of the fabrics. Therefore, these known softener compositions are different from the softener composition of the present invention with respect to the structure of the ammonium salt and the intended purpose of using same, and the present invention is clearly distinguishable from these known softener compositions.

As the quaternary ammonium salts (A) that are used in the present invention, there can be mentioned, for example, dilaurylmethylhydroxyethyl ammonium chloride, dicetylethyl-β-(hydroxyethoxy)ethyl ammonium bromide, distearylmethylhydroxyethyl ammonium chloride, di-β-hydroxydocosylethyl-β-[hydroxy(diethoxy)]ethyl ammonium ethyl sulfate, dilauryldihydroxyethyl ammonium acetate, dimyristylhydroxyethyl-β-(hydroxyethoxy)ethyl ammonium propionate, dihydrogenated beef tallow alkyl-methylhydroxyethyl ammonium chloride, di-hydrogenated beef tallow alkyldihydroxyethyl ammonium bromide, dipalmityl-di-β-hydroxypropyl ammonium β-hydroxyacetate, and mixtures of two or more of these quaternary ammonium salts.

As the anionic surface active agent (B) that is used in the present invention, there can be mentioned, for example, alkali metal salts and water-soluble ammonium salts of alkylbenzenesulfonic acids having an alkyl group of 10 to 18 carbon atoms, alkyl sulfates having an alkyl group of 10 to 20 carbon atoms, polyoxyethylene alkyl ether sulfates having an alkyl group of 12 to 22 carbon atoms and an ethylene oxide polymerization degree of 1 to 5, monoalkyl and dialkyl phosphates having an alkyl group of 10 to 20 carbon atoms, mono- and di-polyoxyethylene alkyl ether phosphates having an alkyl group of 12 to 22 carbon atoms and an ethylene oxide polymerization degree of 1 to 5, fatty acids having 12 to 22 carbon atoms and alkyloxypolyethenoxyacetic acids having an alkyl group of 12 to 22 carbon atoms and an ethylene oxide polymerization degree of 0 to 5, and mixtures of two or more of these alkali metal salts and water-soluble ammonium salts. As specific examples, there can be mentioned sodium dodecylbenzenesulfonate, sodium dodecyl sulfate, triethanol ammonium octadecyl sulfate, ammonium polyoxyethylene($\bar{p}$=1-)dodecyl ether sulfate, diethanol ammonium polyoxyethylene($\bar{p}$=3)octadecyl ether sulfate, sodium monooctadecyl phosphate, ammonium didodecyl phosphate, sodium monopolyoxyethylene($\bar{p}$=2)tetradecyl ether phosphate, triethanol ammonium dipolyoxyethylene($\bar{p}$=5)octadecyl ether phosphate, sodium laurate, potassium myristate, ammonium palmitate, sodium stearate, sodium oleate, sodium dodecyloxyacetate, potassium octadecyloxytriethenoxyacetate, and mixtures of two or more of the foregoing compounds.

The mixing molar ratio of the quaternary ammonium salt (A) and the anionic surface active agent (B) that are used in the fabric softener of the present invention, namely, the mixing molar ratio (A):(B), is from 1:0.3 to 1:1, preferably from 1:0.75 to 1:0.9. When the fabric softener composition of the present invention is used in the liquid form, the total amount of the components (A) and (B) is not particularly critical, but when application conditions in ordinary households are taken into consideration, in view of the softening and antistatic effects, it is preferred that the total amount of the components (A) and (B) be at least 3% by weight, and in view of the viscosity and storage stability of the liquid composition and from the economical viewpoint, it is preferred that the total amount of the components (A) and (B) is not larger than 20% by weight.

The fabric softener composition according to the present invention is characterized by the combined use of the quaternary ammonium salt (A) and the anionic surface active agent (B). When it is used in the form of a liquid softener, the composition of the present invention may further comprise a polyethylene glycol-type non-ionic surface active agent, a water-soluble salt such as sodium chloride or ammonium chloride, a solvent such as propylene glycol or isopropyl alcohol, or urea for improving the storage stability or adjusting the viscosity of the composition.

Moreover, a pigment or dye may be incorporated for improving the appearance of the resulting product, or a fluorescent dye may be incorporated for enhancing the whiteness of the treated fabric. Furthermore, a perfume may be incorporated for giving a good feeling during the treatment or imparting a good odor to a treated fabric.

The effects of the softener composition of the present invention are not adversely affected even when another quaternary ammonium salt-type softener is used in combination therewith.

The present invention will now be further described by reference to the following illustrative Examples.

EXAMPLE 1

The softening and antistatic effects of compositions having the recipe indicated below to various fibers were examined.

| Recipe | |
|---|---|
| Distearylmethylhydroxyethyl ammonium chloride (A): | 4.5% by weight (0.0073 mole) |
| Sodium stearate (B): | 0 to 1.25 equivalents |
| Water: | balance |

(1) Softening Treatment:

Commercially available cotton towel, acrylic jersey cloth, nylon knitwork and Tetron knitwork were washed repeatedly 5 times with a commercially available detergent, New Beads (registered trademark for a product of Kao Soap Co., Ltd.), and fiber treating agents were removed from the thus-washed fiber products. Then, the fiber products were treated in a 0.067% aqueous solution of the above composition (water having a hardness of 3.5° DH being used) at a temperature of 25° C. and a bath ratio of 1/30 for 5 minutes under agitation.

(2) Evaluation:

The clothes treated according to the above-mentioned method were air-dried in a room and were allowed to stand still in a thermostat chamber maintained at a temperature of 25° C. and a relative humidity of 65% for 24 hours.

The softness and antistatic characteristic of each cloth were evaluated in the following manners.

(a) Softness:

The softness was evaluated according to the paired comparison test using as a control a cloth treated with a 0.067% aqueous solution of a softener composition containing 4.5% by weight of distearyldimethyl ammonium chloride (hereinafter referred to as "DSDMAC"), which is now used most popularly as a fabric softener. The evaluation scale is as follows wherein the control is assigned the arbitrary value of 0:

+ 3: very soft
+ 2: soft
+ 1: relatively soft
0: same as control
− 1: relatively hard
− 2: hard
− 3: very hard (b) The antistatic characteristic was evaluated based on the surface resistivity measured by using High Resistance Meter Model 4329A manufactured by Yokohawa Hewlett Packard Co.

(3) Results:

The results obtained are shown in Table 1. As will be apparent from the results shown in Table 1, when the anionic surface active agent (B) is added to the quaternary ammonium salt (A) so that the (B)/(A) molar ratio is from 0.3 to 1.00, preferably from 0.75 to 0.9, the softness and antistatic characteristic of synthetic fibers can be much improved in comparison with the cases wherein the control softener is used or the component (B) is not added.

In the case of cotton, the softness tends to be degraded by addition of the anionic surface active agent, but if the (B)/(A) molar rartio is not higher than 1.00, the tendency is not conspicuous and the softness is improved in comparison with the case wherein the control softener is used.

Table 1

| (B)/(A) Molar Ratio | Cloth Treated: Acrylic Jersey | Nylon Knitwork | Tetron Knitwork | Cotton Towel |
|---|---|---|---|---|
| Softness | | | | |
| 0 | 0 | 0 | 0 | 0 |
| 0.3 | + 0.5 | + 0.5 | + 0.5 | 0 |
| 0.5 | + 2 | + 1 | + 1 | 0 |
| 0.75 | + 3 | + 2 | + 2 | 0 |
| 0.9 | + 3 | + 3 | + 3 | − 0.5 |
| 1.0 | + 2 | + 2 | + 2 | − 0.5 |
| 1.25 | − 2 | − 1 | − 2 | − 2 |
| DSDMAC | control | control | control | control |
| Surface Resistivity (Ω) | | | | |
| 0 | $1.5 \times 10^{12}$ | $2.9 \times 10^{12}$ | $1.0 \times 10^{11}$ | — |
| 0.3 | $9.3 \times 10^{11}$ | $1.0 \times 10^{12}$ | $8.2 \times 10^{10}$ | — |
| 0.5 | $6.3 \times 10^{11}$ | $7.3 \times 10^{11}$ | $1.1 \times 10^{10}$ | |
| 0.75 | $3.2 \times 10^{11}$ | $5.8 \times 10^{11}$ | $5.0 \times 10^{9}$ | — |
| 0.9 | $1.5 \times 10^{11}$ | $4.9 \times 10^{11}$ | $3.2 \times 10^{9}$ | — |
| 1.0 | $5.8 \times 10^{11}$ | $6.3 \times 10^{11}$ | $7.5 \times 10^{9}$ | — |
| 1.25 | $2.9 \times 10^{13}$ | $9.8 \times 10^{12}$ | $4.0 \times 10^{12}$ | — |
| DSDMAC | $2.0 \times 10^{12}$ | $2.2 \times 10^{12}$ | $1.2 \times 10^{11}$ | — |

EXAMPLE 2

| | |
|---|---|
| Distearylmethylhydroxyethyl ammonium chloride (molecular weight = 616) | 6% by weight |
| Sodium dodecylbenzenesulfonate (molecular weight = 348) | 3.1% by weight |
| Water | balance |

EXAMPLE 3

| | |
|---|---|
| Distearylmethylhydroxyethyl ammonium chloride (molecular weight = 616) | 10% by weight |
| Triethanol ammonium octadecyl sulfate (molecular weight = 499) | 8.1% by weight |
| Water | balance |

EXAMPLE 4

| | |
|---|---|
| Distearylmethylhydroxyethyl ammonium chloride (molecular weight = 616) | 5% by weight |
| Sodium salt of hydrogenated beed tallow fatty acid (molecular weight = 292) | 1.8% by weight |
| Polyoxyethylene (p = 100) oleyl ether | 0.3% by weight |
| Perfume and pigment | minute amounts |
| Water | balance |

EXAMPLE 5

| | |
|---|---|
| Distearylmethylhydroxyethyl ammonium chloride (molecular weight = 616) | 3% by weight |
| Ammonium didodecyl phosphate (molecular weight = 456) | 1.1% by weight |
| Urea | 2% by weight |
| Water | balance |

EXAMPLE 6

| | |
|---|---|
| Dilauryl-di-(hydroxyethyl ammonium acetate (molecular weight = 501) | 12% by weight |
| Potassium octadecyloxytriethenoxyacetate (molecular weight = 498) | 6.0% by weight |
| Propylene glycol | 5% by weight |
| Perfume and pigment | minute amounts |
| Water | balance |

EXAMPLE 7

| | |
|---|---|
| Didocosylethyl-β-[hydroxy-(diethoxy)]ethyl ammonium sulfate (molecular weight = 935) | 4% by weight |
| Diethanol ammonium polyoxyethylene (p = 3) octadecyl ether sulfate (molecular weight = 587) | 2.3% by weight |
| Polyoxyethylene (p = 100) lauryl ether | 0.5% by weight |
| Urea | 2% by weight |
| Sodium chloride | 0.3% by weight |
| Perfume and pigment | minute amounts |
| Water | balance |

EXAMPLE 8

| | |
|---|---|
| Di-hydrogenated beef tallow alkyl-methylhydroxyethyl ammonium chloride (molecular weight = 593) | 4.5% by weight |
| Sodium stearate (molecular weight = 306) | 2.1% by weight |
| Propylene glycol | 3% by weight |
| Sodium chloride | 0.1% by weight |
| Perfume and pigment | minute amounts |
| Water | balance |

In the same manners as described in Example 1, the softening and antistatic effects of each of the compositions of the foregoing Examples 2 to 8 were evaluated by using as controls (Controls 2 to 8) corresponding compositions free of the anionic surfactant. The results obtained are shown in Table 2.

As will be apparent from the results shown in Table 2, when the anionic surface active agent (B) is added to the quaternary ammonium salt (A), the softening and antistatic effects to synthetic fibers can be remarkably improved, and the softening effect to cotton fibers is not conspicuously degraded.

Table 2

| Example No. | (B)/(A) Molar Ratio | Softness: Acrylic Jersey | Nylon Knitwork | Tetron Knitwork | Cotton Towel | Surface Resistivity (Ω): Acrylic Jersey | Nylon Knitwork | Tetron Knitwork |
|---|---|---|---|---|---|---|---|---|
| 2 | 0.9 | + 1 | + 1 | + 1 | − 0.5 | $2.5 \times 10^{11}$ | $3.5 \times 10^{11}$ | $9.4 \times 10^{9}$ |
| 3 | 1.0 | + 2 | + 2 | + 1 | − 0.5 | $9.5 \times 10^{10}$ | $1.0 \times 10^{11}$ | $8.3 \times 10^{9}$ |
| 4 | 0.75 | + 3 | + 3 | + 3 | 0 | $2.2 \times 10^{11}$ | $4.0 \times 10^{11}$ | $3.5 \times 10^{9}$ |
| 5 | 0.5 | + 2 | + 1 | + 1 | 0 | $1.3 \times 10^{12}$ | $9.1 \times 10^{11}$ | $5.4 \times 10^{10}$ |
| 6 | 0.5 | + 1 | + 1 | + 1 | − 0.5 | $9.9 \times 10^{10}$ | $7.3 \times 10^{10}$ | $7.4 \times 10^{9}$ |
| 7 | 0.9 | + 1 | + 1 | + 2 | 0 | $7.8 \times 10^{11}$ | $7.0 \times 10^{11}$ | $6.1 \times 10^{10}$ |
| 8 | 0.9 | + 3 | + 3 | + 3 | − 0.5 | $2.5 \times 10^{10}$ | $2.1 \times 10^{11}$ | $4.8 \times 10^{9}$ |
| Control 2 | 0 | control | control | control | control | $8.7 \times 10^{11}$ | $9.3 \times 10^{11}$ | $5.4 \times 10^{10}$ |
| Control 3 | 0 | " | " | " | " | $5.0 \times 10^{11}$ | $4.3 \times 10^{11}$ | $3.1 \times 10^{10}$ |
| Control 4 | 0 | " | " | " | " | $1.0 \times 10^{12}$ | $1.7 \times 10^{12}$ | $6.7 \times 10^{10}$ |
| Control 5 | 0 | " | " | " | " | $5.5 \times 10^{12}$ | $5.9 \times 10^{12}$ | $2.5 \times 10^{11}$ |
| Control 6 | 0 | " | " | " | " | $2.0 \times 10^{11}$ | $1.3 \times 10^{11}$ | $1.8 \times 10^{10}$ |
| Control 7 | 0 | " | " | " | " | $4.3 \times 10^{12}$ | $3.8 \times 10^{12}$ | $1.5 \times 10^{11}$ |

Table 2-continued

| Example No. | (B)/(A) Molar Ratio | Softness: Acrylic Jersey | Nylon Knitwork | Tetron Knitwork | Cotton Towel | Surface Resistivity (Ω): Acrylic Jersey | Nylon Knitwork | Tetron Knitwork |
|---|---|---|---|---|---|---|---|---|
| Control 8 | 0 | " | " | " | " | $2.5 \times 10^{12}$ | $3.3 \times 10^{12}$ | $2.0 \times 10^{11}$ |

The embodiments of the invention in which an exclusive property or privilege is claimed are defined as follows:

1. A liquid fabric softener composition, consisting essentially of (A) a quaternary ammonium salt having the formula:

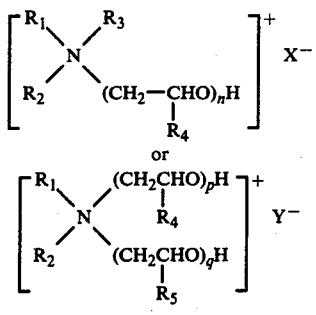

wherein $R_1$ and $R_2$ each are alkyl having 12 to 22 carbon atoms or β-hydroxyalkyl having 13 to 24 carbon atoms, $R_3$ is alkyl having 1 to 3 carbon atoms, $R_4$ and $R_5$ each are hydrogen or methyl, X is halogen, a monoalkyl sulfuric acid group having an alkyl group containing 1 to 3 carbon atoms or a monocarboxylic acid group having 2 or 3 carbon atoms, Y is halogen or a monocarboxylic acid group having 2 or 3 carbon atoms, n is a number of from 1 to 3, and p and q each are a number of 1 or 2 with the proviso that the sum of p and q is 2 or 3, or mixture thereof, (B) an anionic surface active agent or mixture thereof, the mixing molar ratio of (A):(B) being in the range of from 1:0.3 to 1:1, and (C) the balance is essentially water, the sum of (A) plus (B) being from 3 to 20% by weight, based on the total weight of the composition.

2. A fabric softener composition as set forth in claim 1 wherein the quaternary ammonium salt (A) is a compound having the formula:

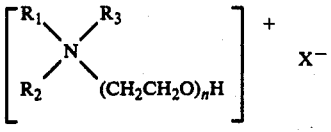

wherein $R_1$ and $R_2$ each are alkyl having 12 to 22 carbon atoms, $R_3$ is alkyl having 1 to 3 carbon atoms, X is halogen and n is a number of from 1 to 3, or a compound having the formula:

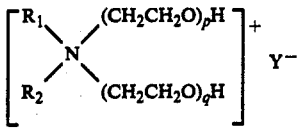

wherein $R_1$ and $R_2$ each are alkyl having 12 to 22 carbon atoms, Y is halogen and p and q each are a number of 1 or 2 with the proviso that the sum of p and q is 2 or 3.

3. A fabric softener composition as set forth in claim 1 wherein the anionic surface active agent (B) is an alkali metal salt of a fatty acid having 12 to 22 carbon atoms or a water-soluble ammonium salt of a fatty acid having 12 to 22 carbon atoms.

4. A fabric softener composition as set forth in claim 1 wherein the quaternary ammonium salt (A) is distearylmethylhydroxyethyl ammonium chloride and the anionic surface active agent (B) is sodium stearate.

5. A fabric softener composition as set forth in claim 1 in which said anionic surface active agent is selected from the group consisting of alkali metal salts and water-soluble ammonium salts of alkylbenzenesulfonic acids having an alkyl group of 10 to 18 carbon atoms, alkyl sulfates having an alkyl group of 10 to 20 carbon atoms, polyoxyethylene alkyl ether sulfates having an alkyl group of 12 to 22 carbon atoms and an ethylene oxide polymerization degree of 1 to 5, monoalkyl and dialkyl phosphates having an alkyl group of 10 to 20 carbon atoms, mono- and di-polyoxyethylene alkyl ether phosphates having an alkyl group of 12 to 22 carbon atoms and an ethylene oxide polymerization degree of 1 to 5, fatty acids having 12 to 22 carbon atoms and alkyloxypolyethenoxyacetic acids having an alkyl group of 12 to 22 carbon atoms and an ethylene oxide polyerization degree of 0 to 5, and mixtures of two or more of these alkali metal salts and water-soluble ammonium salts.

6. A fabric softener composition as set forth in claim 1 in which said quaternary ammonium salt is selected from the group consisting of dilaurylmethylhydroxymethyl ammonium chloride, dicetylethyl-β-(hydroxyethoxy)ethyl ammonium bromide, distearylmethylhydroxyethyl ammonium chloride, di-β-hydroxydocosylethyl-β-[hydroxy(diethoxy)]ethyl ammonium ethyl sulfate, dilauryldihydroxyethyl ammonium acetate, dimyristylhydroxyethyl-β-(hydroxyethoxy)ethyl ammonium propionate, di-hydrogenated beef tallow alkyl-methylhydroxyethyl ammonium chloride, dihydrogenated beef tallow alkyl-dihydroxyethyl ammonium bromide, dipalmityl-di-β-hydroxypropyl ammonium β-hydroxyacetate, and mixtures of two or more of these quaternary ammonium salts, and said anionic surface active agent is selected from the group consisting of sodium dodecylbenzenesulfonate, sodium dodecyl sulfate, triethanol ammonium octadecyl sulfate, ammonium polyoxyethylene($\bar{p}=1$)dodecyl ether sulfate, diethanol ammonium polyoxyethylene($\bar{p}=3$) octadecyl ether sulfate, sodium mono-octadecyl phosphate, ammonium didodecyl phosphate, sodium monopolyoxyethylene($\bar{p}=2$)tetradecyl ether phosphate, triethanol ammonium dipolyoxyethylene($\bar{p}=5$)octadecyl ether phosphate, sodium laurate, potassium myristate, ammonium palmitate, sodium stearate, sodium oleate, sodium dodecyloxyacetate, potassium octadecyloxytriethenoxyacetate, and mixtures of two or more of the foregoing compounds.

7. A fabric softener composition as set forth in claim 6 in which the mixing molar ratio of (A):(B) is from 1:0.75 to 1:0.9.

* * * * *